United States Patent [19]

Araki et al.

[11] 4,368,446

[45] Jan. 11, 1983

[54] SOLENOID

[75] Inventors: Kazuo Araki, Tateyama; Ikuo Tochizawa, Takaoka, both of Japan

[73] Assignee: Kabushiki Kaisha Fujikoshi, Toyama, Japan

[21] Appl. No.: 87,485

[22] Filed: Oct. 23, 1979

[30] Foreign Application Priority Data

Oct. 26, 1978 [JP] Japan ..... 53-146420[U]
Oct. 26, 1978 [JP] Japan ..... 53-146421[U]

[51] Int. Cl.[3] ..... H01F 7/08; H02K 33/02

[52] U.S. Cl. ..... 335/258; 335/262; 310/14; 310/30

[58] Field of Search ..... 310/12, 14, 15, 13, 310/30; 335/258–262

[56] References Cited

U.S. PATENT DOCUMENTS

| | | | |
|---|---|---|---|
| 2,575,095 | 11/1951 | Charbonneau et al. | 335/258 X |
| 3,378,031 | 4/1968 | Hatashita | 310/24 X |
| 3,389,355 | 6/1968 | Schroeder, Jr. | 310/14 X |
| 3,448,307 | 6/1969 | Duriu | 310/30 X |
| 3,805,099 | 4/1974 | Kelly | 310/24 X |
| 4,008,448 | 2/1977 | Muggli | 335/258 |
| 4,016,965 | 4/1977 | Wirth et al. | 335/258 X |
| 4,114,125 | 9/1978 | Komatsu | 335/258 |
| 4,290,039 | 9/1981 | Tochizawa | 335/262 |

*Primary Examiner*—Donovan F. Duggan
*Attorney, Agent, or Firm*—Spencer & Kaye

[57] ABSTRACT

An AC or DC solenoid for operating a hydraulic or air valve, or another machine comprises a means provided at one end of an armature for reducing the effective cross-sectional area of a magnetic path extending through the armature and a yoke when the armature and a stationary core have a distance therebetween which is smaller than a predetermined fraction of the full stroke of movement of the armature. The solenoid is further provided between the armature and the stationary core with a means permitting them to be brought into axially overlapping relation to form a section of leakage flux therebetween. According to another aspect of the invention, there is provided novel means for securing a solenoid of the armature in tube type to a valve body. The improved solenoid has a small size, a long life, and superior performance without causing any excessive attraction over a given small stroke and generating any large noise.

2 Claims, 10 Drawing Figures

FIG. 1
PRIOR ART
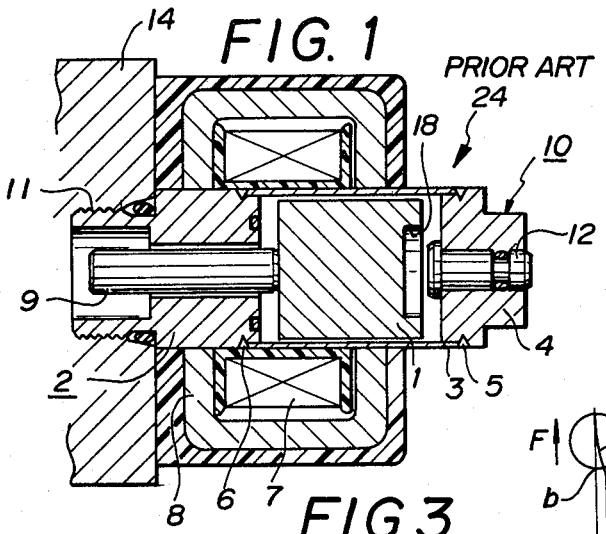
FIG. 1A
PRIOR ART
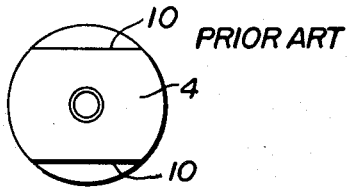
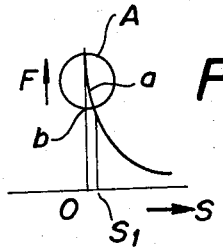
FIG. 2
FIG. 3
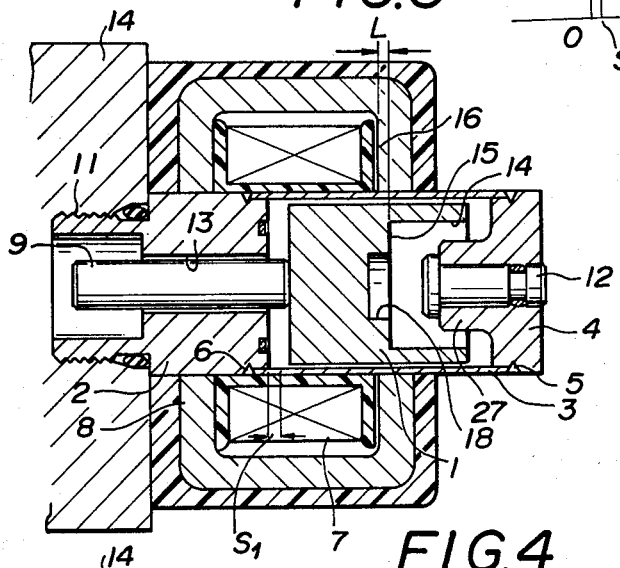
FIG. 4
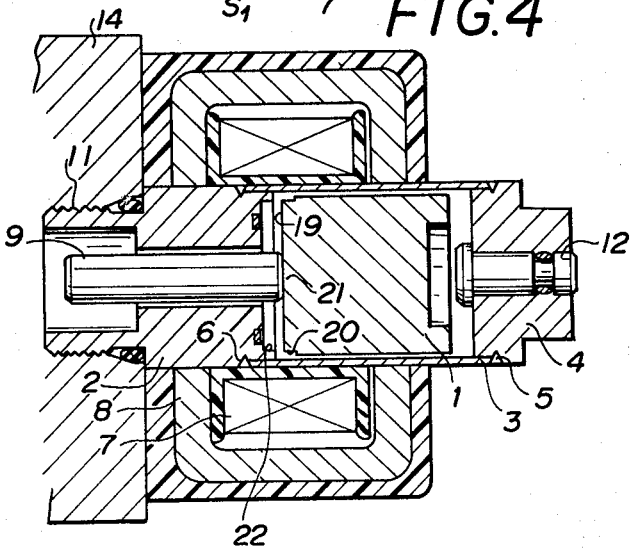

SOLENOID

BACKGROUND OF THE INVENTION

This invention relates to improved AC or DC solenoid for operating hydraulic or air valves, or other machines.

When the circular or polygonal plunger type armature of a solenoid is attracted by a stationary core upon application of alternating or direct current to the solenoid coil, the attraction force-stroke characteristics of the solenoid are generally such that if the stroke S is large, the force F is small, while the force increases with a decrease of the stroke, as shown by curve "a" in FIG. 2. The stroke means the distance between the end surfaces of the armature and the stationary core which contact each other when the armature has moved. Known solenoids have the disadvantages that in order to increase the force for a greater stroke to or over a certain level, it is imperative to increase the force for a smaller stroke to an unnecessary degree, resulting in the generation of noise and the shortening of the life of the armature and the stationary core.

Known solenoids have a path of the magnetic field passing through the yoke 8 of a solenoid coil 7, an armature tube 3, an armature 1, a stationary core 2, the armature tube 3 and the yoke 8 as shown in FIG. 1 labeled "Prior Art." When the armature 1 has been attracted by the stationary core 2, it merely follows that the distance S between the end surfaces of the armature and the stationary core is reduced to zero, with no appreciable change in the magnetic path or the effective cross-sectional area thereof, and therefore, the attractive force becomes stronger with a decrease of the stroke.

A solenoid of the armature in tube type as shown in FIG. 1 (Prior Art) is secured to a valve body by engaging with a thread in the solenoid mounting surface of the valve a thread 11 on the stationary core to which the sealed armature tube through which the armature moves is attached in an oil-tight fashion. In known solenoids of this type, the closure member 4 for the free end of the armature tube 24 is, for example, provided with a grip portion 10 for a tool as shown in FIGS. 1 and 1A (Prior Art), to which a spanner or the like is applied to turn the armature tube 24. The torque which can be applied to turn the armature tube 24 is necessarily limited to protect it against distortion. Consequently, oil leakage is likely to occur between the stationary core 2 and the valve 14 because it is difficult to establish an appropriate seal therebetween, while the application of an excessively great force tends to cause deformation of the thin wall 3 of the armature tube 24. An increase of the wall thickness of the tube 3 leads to the loss of the solenod characteristics because the tube 3 contains non-magnetic material. It also disadvantageously results in a greater tube length. The tube 3 is welded to the closure member 4 and the stationary core 2 at 5 and 6, respectively. The armature 1 has a pin 9 secured thereto. The closure member 4 has a push pin 12.

In view of the aforementioned disadvantages, it has been proposed to provide a tube enclosing the stationary core and form the outer surface of the tube with a grip portion for a tool, as disclosed in an outstanding application of the assignee of this invention which has not yet been published. But this arrangement is still unsatisfactory because there is every possibility that a gap may be formed between the stationary core and the yoke and impair the performance of the solenoid.

It is an object of this invention to solve the aforementioned problems and provide a small AC or DC solenoid having a long life and making only low noise in which any unnecessary increase of the force of attraction for the armature in a position closer to the stationary core is prevented by reducing the effective cross-sectional area of a magnetic path extending through the yoke and the armature, namely, by reducing the number of the lines of effectively acting magnetic flux at one end of the armature.

It is another object of this invention to provide a small AC or DC solenoid having a long life and making only low noise in which that end of an armature which is closer to a stationary core is provided with a means forming a section of leakage flux in which the armature and the stationary core have axially overlapping portions to thereby prevent any unnecessary increase of the force of attraction acting on the armature in a position closer to the stationary core.

It is a further object of this invention to provide an oil-immersed AC or DC solenoid which has eliminated the drawbacks of the prior art, and can be tightly secured to a valve body without impairing the solenoid characteristics or deforming the armature tube.

These and other objects are accomplished by an AC or DC solenoid of the armature in tube type for use with hydraulic or air valves or other machines, which solenoid has an armature, a stationary core, an armature tube secured to the stationary core in an oil-tight fashion and enclosing the armature axially slidably therein, and a yoke and a coil energizing the armature and the stationary core, and further comprises a means provided at an end of the armature for reducing the effective cross-sectional area of a magnetic path through the yoke and the armature when the armature has approached the stationary core more closely than a predetermined distance.

According to another aspect of this invention, in an AC or DC solenoid having an armature, a stationary core, and a yoke and a coil energizing the armature and the stationary core, there is provided an improvement comprising a section of leakage flux formed in an end of the armature closer to the stationary core and in which the armature and the stationary core axially overlap each other.

According to a further aspect of this invention, there is provided an AC or DC solenoid of the armature in tube type having a stationary core, an armature and an armature tube secured to the stationary core in an oil-tight fashion and enclosing the armature axially slidably, and further comprising a threaded portion provided on the outer wall of the stationary core at its end remote from the armature tube and engaged in a threaded hole formed in an adjacent end surface of the valve body, and a tool engaging means provided in a portion of the outer wall of the stationary core remote from the threaded portion thereof.

BRIEF DESCRIPTION OF THE DRAWINGS

This invention will be more fully understood by reference to the following detailed description thereof when read in conjunction with the attached drawings, in which like reference numerals refer to like elements and wherein:

FIG. 1 is a longitudinal sectional view of a known solenoid of the armature in tube type;

FIG. 1A is a side elevational view of the closer member for the armature tube shown in FIG. 1;

FIG. 2 is a graph showing the attractive force-stroke characteristics of solenoids, in which curve "a" refers to a known solenoid, and curve "b" refers to a solenoid of this invention;

FIG. 3 is a longitudinal sectional view of the preferred embodiment of this invention;

FIG. 4 is a longitudinal sectional view of another embodiment of this invention;

DETAILED DESCRIPTION OF THE PREFERRED EMBODIMENTS

Figure 5:
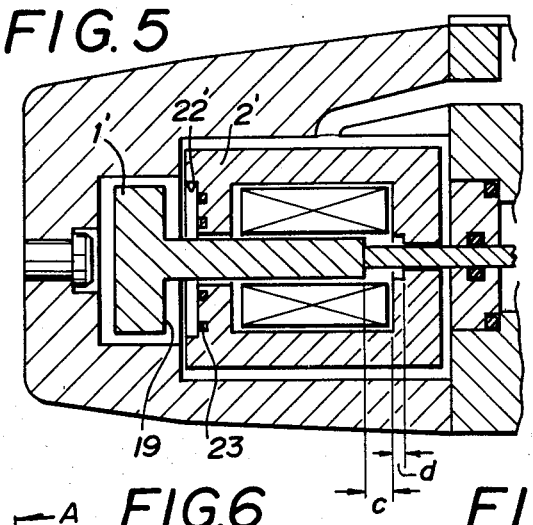
FIG. 5 is a longitudinal sectional view of still another embodiment of this invention.

Referring to the drawings, particularly FIG. 3 thereof, a stationary core 2 has an externally threaded portion 11 by which it is secured to the body of a valve, and an armature 1 is enclosed in an armature tube 3 having one end welded to the stationary core 2 at 6. A plug or closure member 4 is welded to the other end of the armature tube 3 at 5, and has a push pin 12 extending therethrough for moving the armature 1 manually. The stationary core 2 is provided with a through hole 13 through which a push pin 9 extends engageably with the armature 1. The stationary core 2 and the armature tube 3 are surrounded by a coil 7 and a yoke 8 which are adapted to energize the armature 1 and the stationary core 2. The coil 7 is connected to a power source (not shown), which may be AC or DC, by lead wires and terminals (not shown), either. The armature 1 is formed with a recess 14 at an end surface remote from the stationary core 2. The recess 14 has a bottom surface 15 adapted to lie in the plane of an inner wall 16 of the yoke 8 when the armature 1 has approached the stationary core 2 at a distance $S_1$ which is a fraction of the full stroke of movement of the armature 1, so that the force of attraction acting on the armature 1 when it has moved closer to the stationary core 2 than the distance $S_1$ may be prevented from exceeding the necessary level. In FIG. 3, the armature 1 is shown farther from the stationary core 2 by a distance L than the distance $S_1$. The plug 4 has an inwardly extending cylindrical projection 27 received in the recess 14 of the armature 1, and through which the push pin 12 extends.

The cylindrical projection 27 of the plug 4 and the recess 14 of the armature 1 cooperatively contribute to reducing the axial length of the solenoid, so that the solenoid can be shorter and smaller than any known solenoid of the same attractive force having no such recess as shown at 14 in FIG. 3. The recess 14 must have a sufficiently great depth. Known solenoids do also have a recess 18 at corresponding end of the armature as shown by way of example in FIG. 1 (Prior Art), but it has only a depth narrowly receiving the head of the push pin 12. The recess 18 is so shallow that when the armature is magnetically urged toward the stationary core, the effective cross-sectional area of the magnetic path makes only a very small change which does not have any appreciable effect on the force of attraction when the armature has approached the stationary core.

According to this invention, when the armature has a large stroke of movement, it is possible to reduce the thickness of the armature wall defining the recess 14 in an area opposite in the yoke, and the stroke of the armature is so large that the bottom surface 15 of the recess 14 is spaced outwardly of the inner wall 16 of the yoke, i.e., $L>0$, and there is hardly any difference in the force of attraction, whether the recess is present or not. Upon application of alternating or direct current from the power source not shown to the coil 7 through the lead wires and terminals not shown, the armature 1 moves forward or to the left in FIG. 3, and when it has reached the distance $S_1$ which is a fraction of the full stroke of movement of the armature 1, $L=0$, while at $L<0$ with further approach of the armature to the stationary core. When the distance between the armature 1 and the stationary core 2 has become smaller than $S_1$, the magnetic path extending from the yoke 8 through the armature 1 has a smaller cross-sectional area, and the solenoid obtains a smaller force of attraction than when its armature 1 does not have the recess 14. In FIG. 2, curve "b" shows the force-stroke characteristics of the solenoids of this invention shown in FIGS. 3 to 5.

By changing the depth and diameter of the recess 14 appropriately, it is possible to prevent any unnecessary increase of the attractive force preveiling in the solenoid after the armature 1 has reached the position in which the distance between the armature 1 and the stationary core 2 has become smaller than $S_1$. By selecting a different cross-sectional configuration of the recess 14, such as curved, tapered or stepped, appropriately, it is possible to prevent the force of attraction from becoming unnecessarily high as shown by curve "b" in FIG. 2 in an area A in the vicinity of the stationary core 2. It is also possible to obtain a solenoid of which the force-stroke characteristics in the vicinity of the area A can be represented by a horizontal line which indicates that the force is constant, whatever the stroke of the armature may be.

The solenoid shown in FIG. 4 is intended to produce substantially the result of reducing the effective cross-sectional area of the magnetic path by utilizing the leakage flux along the end surface of the armature closer to the stationary core. As opposed to the structure shown in FIG. 3, the armature 1 is provided at its end surface 19 closer to the stationary core 2 with an annular shoulder 20 defining a reduced diameter portion 21 having a smaller diameter than the rest of the armature 1. The end surface of the stationary core 2 facing the end surface 19 of the armature 1 is formed with a circular recess 22 in which the reduced diameter portion 21 can fit to bring the armature 1 and the stationary core 2 into axially overlapping relation to thereby form a section of leakage flux. Thus, the solenoid force can be lowered only when the armature 1 has approached the stationary core 2 more closely than the distance $S_1$, because a part of the magnetic flux then leaks from the armature 1 to a portion of the stationary core 2.

FIG. 5 shows a dry type solenoid having no armature tube. An armature 1' has a surface 19 facing a stationary core 2' and an adjacent end surface of the stationary core 2' is formed with a recess 22 in which the surface 19 of the armature 1' can fit to bring the armature 1' and the stationary core 2' into axially overlapping relation to thereby define a section of leakage flux. The recess 22' is provided with a shading coil 23. The letter "c"

indicates the full stroke of movement of the armature 1', and "d" denotes the distance over which the armature 1' and the stationary core 2' can overlap each other. According to this embodiment, the armature 1' exposed to the air produces such a large impact force that the magnitude of the force of attraction has a great effect on the life of the solenoid. It is, however, still possible to substantially reduce the effective cross-sectional area of a magnetic path and prevent any unnecessary increase of the force of attraction prevailing in the solenoid when the armature 1' has approached the stationary core 2' more closely than the distance $S_1$, because the leakage of flux occurs at one or both ends of the armature 1'.

As hereinabove described with reference to the embodiments shown in FIGS. 3 to 5, this invention is characterized by the provision of a means, such as a recess and a section of leakage flux, at either end of the armature for substantially reducing the effective cross-sectional area of the magnetic path extending through the yoke and the armature when the distance between the armature and the stationary core is smaller than a fraction of the full stroke of movement of the armature. This arrangement makes it possible to prevent any unnecessary increase of the force of attraction prevailing in the solenoid, with the advantageous results that the solenoid has a prolonged life, does not produce any serious noise, and can be made smaller in size. It will also be noted that this invention is equally applicable to both AC and DC solenoid coils.

Attention is now directed to FIGS. 6, 6A, 7 and 7A illustrating novel means for securing the stationary cores of AC or DC solenoids of the armature in tube type to hydraulic or air valves or other machines.

Figure 6:
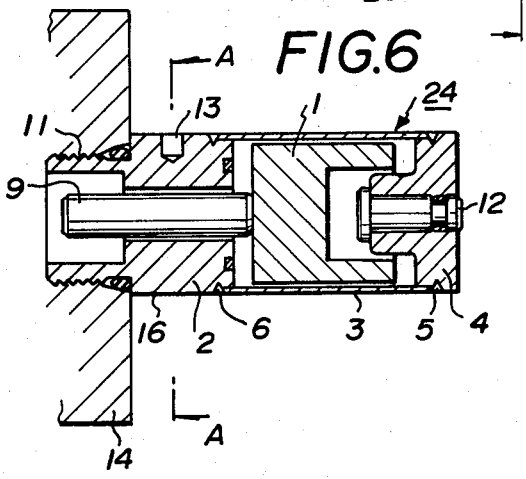
FIG. 6 is a fragmentary longitudinal sectional view of a further embodiment of this invention.
Figure 6A:
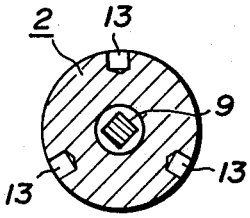
FIG. 6A is a cross-sectional view taken along the line A—A of FIG. 6.

Referring first to FIGS. 6 and 6A, there is shown a solenoid including an armature 1, a stationary coil 2, and an armature tube 24 welded to the stationary core 2 at 6 in an oil-tight fashion and enclosing the armature axially slidably. A core 7 and a yoke 8 are removably secured to the armature tube 24 as shown in FIG. 3. The armature tube 24 comprises a tube 3 of nonmagnetic material having a small wall thickness and a plug or closure member 4 welded to the free end of the tube 3 at 5. The plug 4 is provided with a push pin 12 by which the armature 1 can be pushed from outside. The stationary core 2 has an axial bore and a pin 9 extending through the axial bore. The armature 1 is engageable with the pin 9 to push it to perform change-over of the valve member (not shown) in the valve 14. The stationary core 2 has an end portion remote from the armature tube 24 and which is formed around its outer surface with an external thread 11 engageable with an internally threaded hole in the valve 14 to which the solenoid is attached. A middle portion of the stationary core 2 which is remote from the threaded portion 11 thereof is provided in its outer peripheral surface 16 with three tool engaging holes 13 by which a tool not shown is connected to the solenoid to secure it to the valve 14. The tool engaging holes 13 may be round drilled holes, or may alternatively be square in cross section, depending on the shape of the tool to be used. Although three holes are shown, the stationary core 2 may instead be provided with only one or two such holes, or even four or more ones. A spanner or any other appropriate tool can be engaged with the tool engaging holes 13 to rotate the stationary core 2 and the armature tube 24 to accomplish easily their rigid connection to the valve 14. Accordingly, the solenoid of this invention does not require any more the provision of any such grip portion for a tool as shown at 10 in FIG. 1 (Prior Art), but may be smaller in length and more compact in construction. It is also possible to apply a sufficiently large torque to eliminate all the possibility of oil leakage through the joint between the solenoid and the valve, without applying to the tube 3 any unduly great force that has often caused deformation of the tube in the prior art during the connection of the solenoid to the valve. The stationary core 2 and the armature tube 24 are surrounded by a bobbin enclosing a coil 7 and a yoke 8 as shown in FIG. 1 (Prior Art). The tool engaging holes 13 do not create any gap between the stationary core 2 and the yoke 8 that may impair the solenoid performance. As the wall thickness of the thin-walled tube 3 can be further reduced, the performance of the solenoid can be further enhanced in accordance with this invention.

Figure 7:
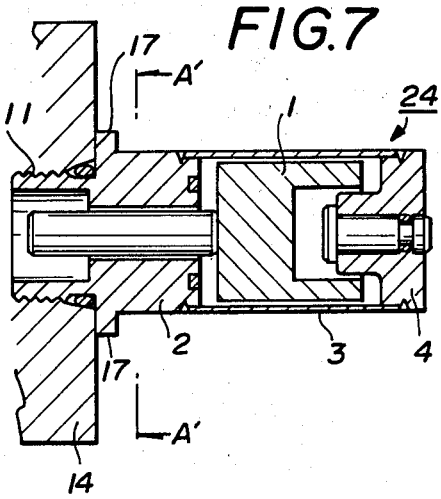
FIG. 7 is a fragmentary longitudinal sectional view of a still further embodiment of this invention.
Figure 7A:
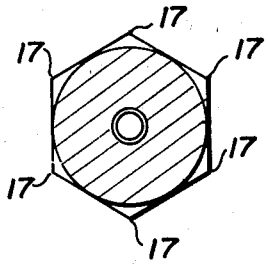
FIG. 7A is a cross-sectional view taken along the line A'—A' of FIG. 7.

FIGS. 7 and 7A show an alternative arrangement for connecting the solenoid to the valve 14 by using a tool not shown. The stationary core 2 is provided with a hexagonal flange 17 for engaging a tool adjacent to its threaded end portion 11, i.e., in close proximity to the valve 14 when the solenoid is secured to it. The hexagonal flange 17 is interposed between the yoke 8 and the valve 14, so that no gap is formed between the stationary core 2 and the yoke 8. The arrangement can produce the same advantageous results as those described with reference to FIGS. 6 and 6A. The flange 17 may be of any other shape, such as square, or seven- or more-angled, instead of being hexagonal, or may be replaced by one or more round or square stud projections.

It will be understood that this invention will be equally applicable to the solenoid in which a cover is provided to enclose the stationary core. Although the invention has been described with reference to preferred embodiments thereof directed to push type solenoids in which the armature urges the push pin to move forward to change over the position of a valve member, it will be obvious for anybody skilled in the art to apply this invention to pull type solenoids having a pull pin secured to the armature at one end and to a valve member at the other end and in which the armature is displaced in a direction to pull the pull pin to thereby change over the valve position. Therefore, the solenoids comprehend both push and pull type ones in the context of this specification.

Although preferred embodiments of the invention have been described in considerable detail for illustrutive purposes, many changes or modifications will occur to those skilled in the art, without departing from the scope of the appended claims of this invention. It is therefore desired that the protection afforded by Letter Patent be limited only by the true scope of the appended claims.

What is claimed is:

1. An AC or DC solenoid of the armature-in-tube type comprising a stationary core; an armature; an armature tube secured to said stationary core to form an oil-tight seal and enclosing said armature, said armature being axially slidable within said armature tube; and a yoke and a coil for energizing said stationary core and said armature, said solenoid having means provided at an end of said armature for reducing the effective cross-sectional area of the magnetic path extending through said yoke and said armature when the distance between said armature and said stationary core is less than a predetermined fraction of the full stroke of movement of said armature, said means for reducing the effective cross-sectional area of said magnetic path comprising a recess formed in an end surface of said armature remote from said stationary core, said recess having a bottom surface which lies in the plane of an inner wall of said yoke when said distance between said armature and said stationary core is equal to said predetermined fraction.

2. A solenoid as set forth in claim 1 wherein said armature tube is provided with a closure member having a projection, said projection extending into the recess in said armature.

* * * * *